US011293073B2

(12) United States Patent
Saha et al.

(10) Patent No.: US 11,293,073 B2
(45) Date of Patent: Apr. 5, 2022

(54) HOT ROLLED STEEL PRODUCT WITH ULTRA-HIGH STRENGTH MINIMUM 1100MPA AND GOOD ELONGATION 21%

(71) Applicant: TATA STEEL LIMITED, Jamshedpur (IN)

(72) Inventors: Rajib Saha, Jamshedpur (IN); Saurabh Kundu, Jamshedpur (IN); A. N. Bhagat, Jamshedpur (IN)

(73) Assignee: TATA STEEL LIMITED, Jamshedpur (IN)

( * ) Notice: Subject to any disclaimer, the term of this patent is extended or adjusted under 35 U.S.C. 154(b) by 0 days.

(21) Appl. No.: 16/490,826

(22) PCT Filed: Nov. 15, 2017

(86) PCT No.: PCT/IN2017/050532
§ 371 (c)(1),
(2) Date: Sep. 3, 2019

(87) PCT Pub. No.: WO2018/163189
PCT Pub. Date: Sep. 13, 2018

(65) Prior Publication Data

US 2020/0010921 A1 Jan. 9, 2020

(30) Foreign Application Priority Data

Mar. 10, 2017 (IN) ..... 201731008461

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
CPC ..... C21D 9/46; C21D 6/002; C21D 6/005; C21D 6/008; C22C 38/001; C22C 38/002;
(Continued)

(56) References Cited

U.S. PATENT DOCUMENTS 6,159,312 A 12/2000 Koo et al.
2014/0102600 A1 4/2014 Sourav et al.
(Continued)

FOREIGN PATENT DOCUMENTS

JP 2016145415 A * 8/2016
WO WO-2016063224 A1 4/2016

OTHER PUBLICATIONS

English language machine translation of JP-2016145415-A to Tomita. Generated Feb. 25, 2020. (Year: 2020).*
(Continued)

*Primary Examiner* — Brian D Walck
(74) *Attorney, Agent, or Firm* — Hamess, Dickey & Pierce, P.L.C.

(57) ABSTRACT

Present invention discloses a high strength hot rolled steel product with tensile strength at least 1100 MPa and elongation not less than 21%. The steel further has uniform elongation not less than 10% and yield and tensile ratio 0.6-0.7. The steel further has tensile toughness in the range 19-23.5 GPa %. The developed steel is primarily aimed for automotive structural applications and also for many other such as defence where good combination of strength and ductility required is very high. The developed steel product has following composition C: 0.15-0.23, Mn: 0.8-2.1, Si: 0.3-1.1, Cr: 0.8-1.3, Mo: 0.08-0.25, Nb: 0.018-0.035, Ti—0.01-0.1 S—0.008 max, P—0.025 max, Al—0.05 to 0.3, N—0.005 max. The liquid metal was continuous cast into slab casting. The cast slab was soaked above 1150° C.
(Continued)

Strength – Elongation plot of the developed steel for few hours and subsequently the cast structure was broken by deformation prior to hot rolling. The slab was then hot rolled into strip with thickness not less than 10 mm with finish rolling temperature in austenite region and subsequently cooled to above Ms (martensite temperature) but below Bs (Below Bainite start temperature) to avoid polygonal ferrite. The steel with above mentioned properties was developed using existing hot rolling.

14 Claims, 3 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/38*** | (2006.01) |

(52) U.S. Cl.
CPC ..... *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/22* (2013.01); *C22C 38/26* (2013.01); *C22C 38/28* (2013.01); *C22C 38/38* (2013.01); *C21D 2211/001* (2013.01); *C21D 2211/002* (2013.01); *C21D 2211/008* (2013.01)

(58) Field of Classification Search
CPC ..... C22C 38/02; C22C 38/06; C22C 38/22; C22C 38/26; C22C 38/28; C22C 38/38
USPC ..... 148/320
See application file for complete search history.

(56) References Cited

U.S. PATENT DOCUMENTS

| | | | |
|---|---|---|---|
| 2015/0059935 | A1 | 3/2015 | Hebesberger et al. |
| 2016/0222485 | A1 | 8/2016 | Murakami et al. |
| 2016/0273066 | A1* | 9/2016 | Sakakibara ..... B32B 15/013 |
| 2018/0187283 | A1 | 7/2018 | Chintha et al. |

OTHER PUBLICATIONS

C. Garcia-Mateo et al "Development Of Hard Bainite", ISIJ International, vol. 43, No. 8, pp. 1238-1243 (2003).
F. G. Caballero et al "Design Of Advanced Bainitic Steels by Optimisation of TTT Diagrams and To Curves", ISIJ International, vol. 46, No. 10, pp. 1479-1488 (2006).
F. G. Caballero et al, "Very Strong Low Temperature Bainite", Materials Science and Technology, vol. 18, pp. 279-284 (2002).
H. Bhadeshia, "Properties Of Fine-Grained Steels Generated By Displacive Transformation", Materials Science and Engineering A, 481-482, pp. 36-39 (2008).
F.G. Caballero, et al "Theoretical Design And Advanced Microstructure In Super High Strength Steels", Materials & Design, vol. 30, Issue 6, pp. 2077-2083 (Jun. 2009).
International Search Report and Written Opinion issued in PCT/IN2017/050532 dated Jan. 30, 2018; ISA/EP.

* cited by examiner

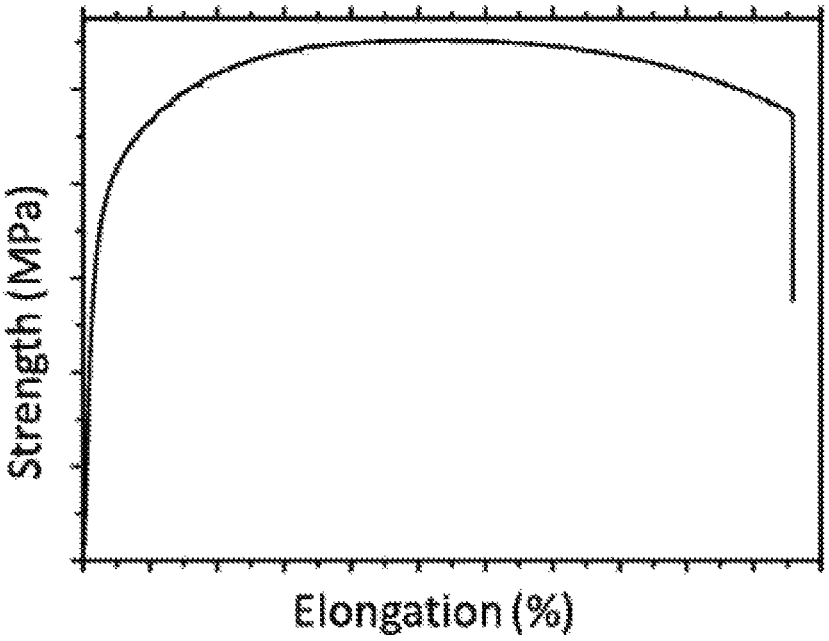
Figure 1 Strength –Elongation plot of the developed steel
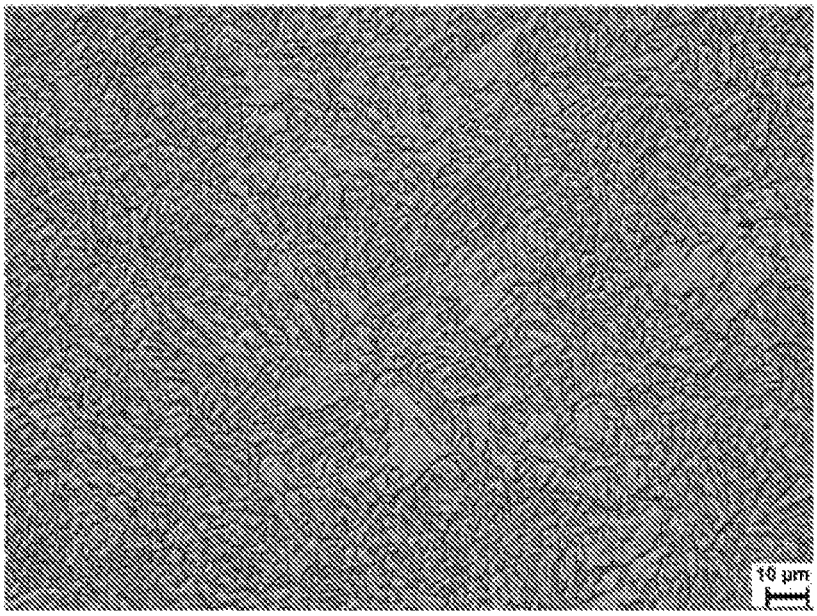
Figure 2 Optical micrograph of the developed steel

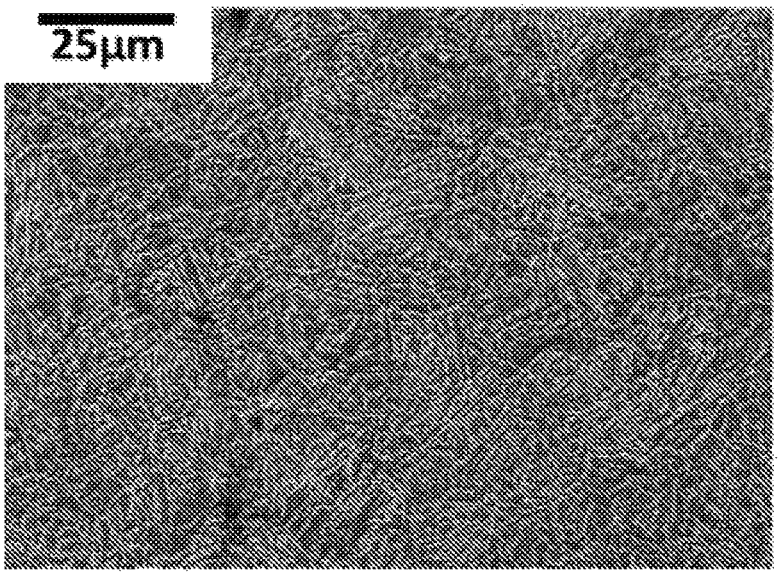
Figure 3SEM micrograph of the developed steel
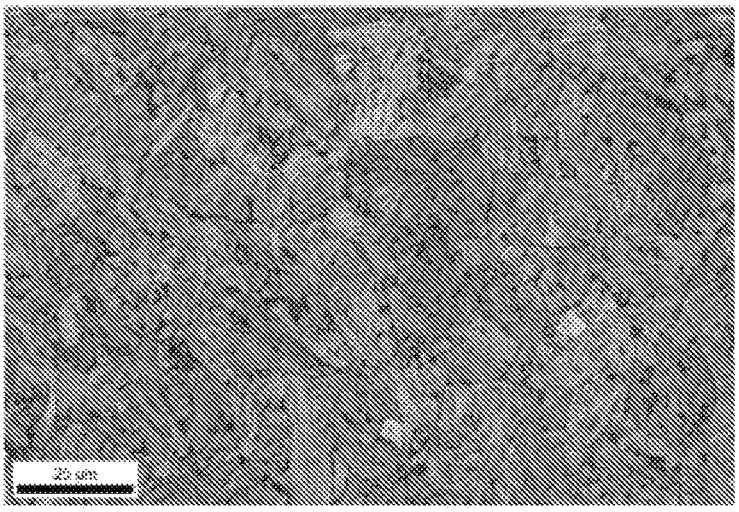
Figure 4 EBSD micrograph of the developed steel

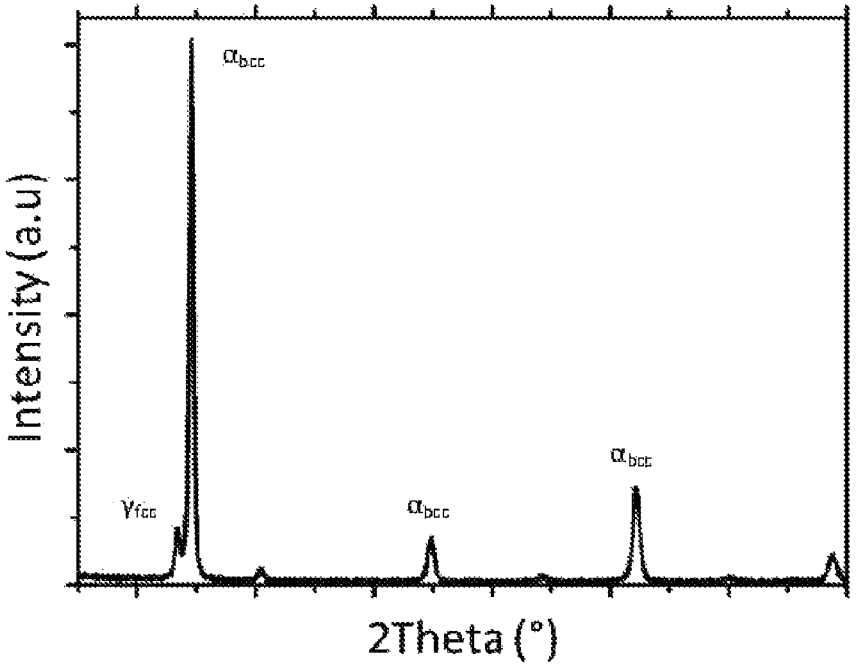
Figure 5 X-Ray diffraction profile of the developed ultra- high strength steel

HOT ROLLED STEEL PRODUCT WITH ULTRA-HIGH STRENGTH MINIMUM 1100MPA AND GOOD ELONGATION 21%

CROSS-REFERENCE TO RELATED APPLICATIONS

This patent application is a 371 U.S. National Phase of International Application No. PCT/IN2017/050532, filed on Nov. 15, 2017, which claims priority to Indian Application No. 201731008461 filed on Mar. 10, 2017. The entire disclosures of these applications are incorporated herein by reference.

FIELD OF THE INVENTION

The present invention discloses high strength hot rolled steel product with tensile strength of at least 1100 MPa and elongation not less than 21%. The steel further has uniform elongation not less than 10-12% and yield and tensile ratio 0.6-0.7. The developed steel further has tensile toughness in the range 19-23.5 GPa %, highly suitable for automotive structural and load bearing application, automotive bumper, defence equipment making, mining etc. applications.

BACKGROUND OF THE INVENTION

In automotive sector reduction in fuel consumption, therefore, lowering emission and maintaining high standard of safety demands use of stronger steel. Both the needs could be fulfilled through use of advanced high strength steels (AHSS) with high elongation. Ultra high strength (UHSS) or AHSS are not new until now. However, major issue with the UHSS is poor forming capability and weak load bearing capability due to limited elongation. As strength and elongation behaves opposite way in metals and alloys, therefore, with the development of stronger or UHSS steel, quite naturally the elongation also reduces or decreases significantly. As a result the application scope of UHSS for various parts in motor vehicle gets limited as forming become increasingly difficult. Therefore, UHSS steel development equally demands high elongation and formability. The situation/scenario mentioned has necessitated development of a hot rolled ultra-high strength (UHSS) thin steel sheet with combination of high tensile strength and extraordinary uniform elongation and total elongation for various automotive component such as lower suspension, long and cross member and bumpers as well.

Strong and tough steel is one of the major contributors to control air pollution. Light-weight environmental friendly vehicle design is essential now-a-days to address the problems of environmental pollution. Effective light-weight motor vehicles require utilization of advanced high strength and ultra-high strength steel (UHSS) sheets. However, because of its poor formability, the UHSS sheet cannot be applied easily to a wide variety of motor vehicle components. Hence, the ductility and formability required for UHSS sheet becomes increasingly demanding. Therefore addressing the present scenario has necessitated development of a hot rolled steel strip with high tensile strength coupled with excellent elongation for various automotive components such as lower suspension, long and cross member and bumpers as well.

In the recent past many researchers have attempted to develop UHSS steels. First such steel sheet with very high strength was reported by Bhadeshia, *MSE-A*, Volume 481-482, pp. 36-39, 2008; F. G. Caballero, H. K. D. H. Bhadeshia, K. J. A. Mawella, D. G. Jones and P. Brown, *MST*, Volume 18, pp. 279-284, 2002; C. Garcia-Mateo, F. G. Caballero and H. K. D. Bhadeshia, *ISIJ International*, Volume 43, pp. 1238-1243, 2003). The source of very high strength was attributed to presence of nanostructured bainite or nano bainite. Although, the steel developed by Bhadeshia et.al. has very high strength, however, the application scope in automotive and many other is very limited specially due to high alloy content, long production time (3-4 days), limited elongation (<10%). The first two factors makes difficulty in real production line whereas the last one is not favourable in end user side. The higher carbon content (>0.7 wt %) makes the steel difficult for welding. Overall the steel is expansive and has inadequate formability.

Another group of researcher [(F. G. Caballero, M. J. Santofima, C. Capdevila, C. G. Mateo and C. G. De Andres, *ISIJ International*, Volume 46, pp. 1479-1488, 2006; F. G. Caballero, M. J. Santofima, C. Garcia Mateo, J. Chao and C. Garcia de Andres, *Materials and Design*, Volume 30, pp. 2077-2083, 2009] came with slightly different thought and tried to address the issues mentioned in last paragraph. These researchers attempted to improve the overall elongation, lower the cost and accelerate the production in real line and easily weldable by adjusting the composition through lowering of carbon content. However, the steel has not been considered for continuous production line for various reasons and also the steels contain high amount of expensive alloying additions like Ni and Mo in their production.

In an effort to meet the demand of present day motor vehicle manufacturers, recent work (Ref. US 2014/0102600 A1) attempted to obtain high strength and ductility combination. This work has successfully achieved minimum 1200 MPa tensile strength with 20% total elongation. However, it has high Carbon (>0.3 wt. %) and Silicon (>1.5 wt. %). High amount of Carbon decreases the weldability and high Silicon causes surface scales during the process of hot rolled steel sheets. These problems yet to be addressed.

Very recently, another team of researcher [Rao et.al. TSL Application no: 201631011120] has developed a high strength steel with tensile strength greater than 1000 MPa with elongation 15-16% with yield strength 615 MPa. Although the steel has good combination of strength and ductility but it has quite high amount of silicon which is not desirable from surface and coating point of view. Steel with such high silicon content also offer greater difficulty during rolling process in terms of product quality.

Under the current invention the aim was to identify suitable processing route/parameters for the development UHSS steel that has super high elongation, good weldability, commercial viability and also to produce through the existing hot rolling mill facilities. The amount of carbon and manganese is restricted below certain level for better weldability, silicon was also kept lower to address the scale problem during hot rolling process. The optimum cooling and coiling was identified to ensure the steel could be produced under conventional mill operating parameters in the same run out table to obtain thicker sheet with high strength and elongation. The high strength and elongation was achieved through formation of low temperature phases mixture of bainte and martensite with small amount of retained austenitein final microstructure. The above mentioned phase constituent ensured the steel invented has ultra high strength with tensile strength at least 1100 MPa and elongation not less than 21%.

OBJECTS OF THE INVENTION

It is, therefore, an object of the present invention to propose a hot rolled advanced high strength bainitic steel thick strip product which eliminates the disadvantages of prior art.

Further object of the present invention is to propose development of hot rolled product thickness minimum 10 with tensile strength at least 1100 MPa and total elongation minimum 21%.

A still another object of the present invention is to propose development of hot rolled product thickness minimum 10 with YS:TS ratio above 0.6.

A still another object of the present invention is to propose development of hot rolled product thickness minimum 10% with tensile toughness in the range 19 GPa-23.5 GPa.

Another object of the present invention is to propose hot rolled very high strength thick steel strip comprising product comprising of microstructural constituents 10-14% martensite, 85-80% bainite and 5-6% austenite.

A further objective of the present invention is to propose that the steel was made using convention existing hot rolling mill comprising of soaking, austenite hot rolling and subsequent coiling above Ms temperature (martensitic start) but below Bs (bainitic start) temperature but followed by air cooling to ambient temperature to achieve above mentioned combination of properties.

BRIEF DESCRIPTION OF THE ACCOMPANYING DRAWINGS

FIG. 1 Strength-Elongation plot of the newly developed steel

FIG. 2 Optical microstructure of the developed steel

FIG. 3 Scanning Electron Microscope microstructure of the newly developed steel FIG. 4 EBSD micrograph of the developed steel FIG. 5 X-ray diffraction profile of the newly developed steel Table 1 Tensile properties of the newly developed steel

DETAILED DESCRIPTION OF A PREFERRED EMBODIMENT OF THE INVENTION

The present invention relates to a method of development of advanced high strength steel strip that comprises preparation of liquid steel to achieve following alloy composition:

C: 0.15-0.25, Mn: 0.8-2.1, Si: 0.4-1.1, Cr: 0.8-1.5, Al: 0.05-0.3, Mo: 0.05-0.25, Nb: 0.018-0.035, Ti—0.01-0.1 S—0.008 max, P—0.025 max, N—0.005 max.

The tensile properties of steel developed as per the current invention has the property as described in the table 1 below:

TABLE 1

Tensile Properties of the developed steel

| Tensile Strength (MPa) | Uniform elongation (%) | Total elongation (%) | Strain hardening coefficient (n) | Toughness GPa % |
|---|---|---|---|---|
| 1105-1125 | 10-12 | 21-23 | 0.15-0.19 | 19-23.5 |

Description of the primary components constitutes (in weight percentage) the newly developed hot rolled steel sheet are described below.

C: 0.15-0.25 wt. %. Amount of carbon content must be adjusted to achieve desired strengthening, proportion of phase fractions so that proper strength level can be obtained. Amount of carbon also determine stability of retained austenite which is key to obtained enhanced elongation. Carbon level must also be controlled to ensure good weldability. Preferable carbon content should be kept below 0.20% to achieve desired strength and elongation and also weldability, therefore, should be restricted below 0.21%.

Mn: 0.8-2.1 wt. % Manganese addition ensured presence of stable retained austenite. However, its amount should be 0.8 or more, preferably 1.2 or more, more preferably 1.5% or more. The amount of Mn needs to be 1.0% or more, preferably 1.3% or more, more preferably 1.5% or more. Manganese amount should preferably be less than 2.1% to avoid welding and casting crack Al: 0.05-2.0 wt. % Al is a stronger ferrite stabilizer. It does not allow the carbon to come out easily from retained austenite, thereby, allow more amount of retained austenite to be formed during bainite reaction. Al addition is favourable over Silicon addition from galvanizing point of view. However, the amount should not be excessive, which might further create problem during casting. Excess Al might allow formation of hard oxides in the weld area, thereby, deteriorate weldability. Hence, Al content in the newly developed steel should be maintained 0.6% or preferably above 0.1 wt % or more preferably below 0.3. To ensure beneficial effect of Al the addition must be above 0.08 wt %. Preferably, Al vanes in the range of 0.1 to 0.29.

Si: 0.4-1.0 wt. % Silicon is also a ferrite stabiliser. Silicon suppress carbide precipitation during bainite transformation during constant temperature holding/coiling and alloy formation of greater amount of retained austenite in the microstructure. Excess amount of silicon addition in steel is detrimental due to varieties of scale formation during hot rolling and cooling. Scale formation leads to surface deterioration and reduce coatability/gavanizibility. Hence, Si should be restricted within certain range as mentioned and more preferably below 0.7 wt %. Preferably, Si varies in the range of 0.4 to 0.8.

P: 0.028% maximum: Phosphorus is considered detrimental in steel. Therefore, should be amount be restricted to 0.028% maximum or preferably 0.02% or less.

S: 0.014% maximum: Like Phosphrous Sulphur is also considered detrimental. So sulphur content to be kept as low as possible, preferably below 0.014 wt %.

More preferably sulphurs contenr should be below 0.01 wt % to minimize the amount of inclusions which is potential sites for premature failure during forming operations.

N: 0.005% maximum: Excess nitrogen in steels is also detrimental. Excess nitrogen may lead to hard inclusions such as TiN and AlN which deteriorate formability. Therefore, nitrogen content has to be restricted below 0.005 wt %.

Nb: 0.1% maximum: Niobium is added to increase the strength of the steel by various mechanism such as grain refinement, precipitation. Nb addition also useful to have larger amount of retained austenite in the microstructure. Nb should be added carefully and optimized to take advantage of economic advantage as Nb is costly. Therefore, Nb level should be below 0.09% or more preferably, below 0.055%.

Mo: 0.25 wt. % maximum: Molybdenum is added to enhance the hardenability in steel, thereby, favors easy formation of bainite. Due to excess hardenability softer ferrite and relatively harder pearlite phase formation could be suppressed during bainitic reaction. As Mo is costly, therefore, its amount should be restricted below 0.25 wt % to make the steel economical and taking processing advantage during hot rolling. Preferably, Mo varies in the range of 0.08 to 0.12 weight percentage.

Cr: 1.55 wt. % maximum: Function of Chromium very much similar to Mo, avoids formation of polygonal ferrite and pearlite. Cr addition is more economical in advanced high strength steel. However, Cr could be harmful if added excessive amount as Cr form various kind of carbides. Preferably, Cr varies in the range (weight percentage) of 0.85 to 1.1.

Ti: 0.1 wt % maximum: Ti is beneficial to restrict austenite grain growth. In addition, Ti also form very fine carbonitride in the presence of Nb, V and increase strength. Excess amount of Ti could be harmful as Ti has tendency to form hard TiN inclusions. Therefore, amount of Ti should be restricted below 0.1 wt % and more preferably, below 0.05 wt %. Preferably, Ti varies in the range of 0.02 to 0.04.

The developed ultra high strength hot rolled steel comprising mainly banitic ferrite phase 80-85% and remaining retained austenite phase (5-6%). Small amount of hard martensite phase (10-14%) is also present in the steel at ambient temperature. Preferably 5-6% austenite phase is present in the range of 5-6%.

Bainite: The bainite present (80-85%) in the microstructure is essentially carbide free with high dislocation density. The bainite is typically lath in nature. Higher dislocation density, therefore, results in higher strength and good ductility.

Retained Austenite: Retained austenite (5-6%) is one of the important constituents of the microstructure of the steel developed. Retained austenite helps to enhance the ductility. To get beneficial effect microstructure should have at least 10% and preferably 12% or higher austenite. Small amount of retained austenite present in the developed steel is good for enhancing ductility.

Martensite: The hot rolled steel strip produced according to the present invention has also some amount of martensite, preferably, not exceed 10-14%.

According to the present invention the method adapted to develop the steel product with the specified composition consists of following steps: alloy melting or heat making, casting, hot rolling, accelerated cooling and coiling and cooling to ambient temperature. Each and every processing steps involved are derailed below:

According to the present invention the alloy was melted in induction furnace and subsequently cast in the form of 70-80 mm thick bar or ingot. The ingot was homogenized by keeping the steel in the austenite for sufficient time and subsequently reducing the temperature to deform in the austenite and forged to break the cast structure and reduce the thickness suitable for rolling process and subsequently air cooled to ambient temperature. The homogenized steel was prepared for hot rolling. Prior to hot rolling the steel was soaked at high temperature above 1130° C. for 2-4 hours and subsequently hot rolled to thickness minimum 10 mm with finish rolling temperature keeping in the austenite region and subsequently coiling was done into salt bath or similar kind of arrangement at predetermined temperature above Ms bit below Bs and hold for few hours. Coiled steel samples were then transferred to air and allowed to cool to ambient temperature. Specimens for microstructure and mechanical properties were taken from the hot rolled sheet. Microstructural characterization was carried out using optical, scanning electron microscope and orientation imaging microscopy. Mechanical properties were evaluated by Vickers hardness method and tensile tests were performed as per ASTM standard. X-Ray diffraction was employed to confirm the microstructural constituents.

Mechanical properties of the new developed steel are evaluated by tensile testing. Tensile stress-strain curve of the invented steel is depicted in FIG. 1. Figure shows the steel has very high tensile strength and tensile ductility. Ultimate tensile strength (UTS) and elongation of the steel is at least 1100 MPa and 21% respectively. The strain hardening exponent value is in the range 0.15 to 0.19. The uniform elongation is in the range 10-12%. The optical micrograph of the newly developed steel is presented in FIG. 2. The micrograph confirms that the developed steel has predominantly banitic ferrite with small amount of retained austenite and some martensite. The scanning electron micrographs presented in FIG. 3 further confirmed that the invented steel contains mainly bainite with small amount of other phases such as retained austenite and martensite. EBSD micrograph further ensured the observation made in FIGS. 1 and 2. Thickness of banitie sheaves determines the strength and toughness of the steel. The thickness of sheaves was found below submicron level. X-ray diffraction carried is out on the developed steel showed presence diffraction peaks from body centre cubic (BCC) indicated by $\alpha_{bcc}$ and face centre cubic (FCC) austenite indicated by $\gamma_{fcc}$ peak in the plot shown in FIG. 4. The intensity of the BCC phase peak is several times higher than the intensity of the FCC peak clearly confirmed the amount of BCC bainite phase is the major phase in the developed steel. This confirms that the newly steel developed has mainly the bainite structure and some amount of martensite along with little amount of retained austenite. The amount of retained austenite determined at least 5-5%. Electron back scatter diffraction (EBSD) presence of small amount of retained austenite.

EXAMPLES

The following examples are specified to illustrate the invention as described above and in no way restricts the scope of invention.

| C | Mn | Si | Cr | Mo | Al | Ti | Nb | P | S | N | TS MPa | UEL % | TEL | n | |
|---|---|---|---|---|---|---|---|---|---|---|---|---|---|---|---|
| 0.19 | 1.57 | 0.60 | 1.10 | 0.10 | 0.24 | 0.032 | 0.03 | 0.021 | 0.0012 | 0.009 | 1105 | 11 | 23 | 0.18 | Example 1 |
| 0.19 | 1.55 | 0.66 | 0.99 | 0.11 | 0.21 | 0.03 | 0.027 | 0.02 | 0.001 | 0.012 | 1120 | 13 | 22 | 0.17 | Example 2 |
| 0.21 | 1.60 | 0.68 | 0.91 | 0.13 | 0.19 | 0.03 | 0.025 | 0.019 | 0.001 | 0.01 | 1140 | 10 | 18 | 0.15 | Example 3 |

The steels developed according to present invention is shown in table 1 and designated as example 1, example 2 and example 3. The processing conditions involved for these examples are described below:

The developed steel given in example 1 was soaked in the temperature 1220-1230° C. using heating rate 5-10° C./. The steel was cooled and subjected to rough rolling in the temperature range 1080-1100° C. applying deformation in the range 55-80%. The rough rolled steel was further cooled and subjected to hot rolling with finishing rolling temperature in the range 1000-1010° C. applying deformation 55-70%. The steel finished rolled steel was cooled using cooling rate not less than 5° C./s and coiled in the temperature range 415-450° C. followed by air cooling to room temperature.

The steel given in example 2 was processed by soaking in the temperature 1245-1260° C. The heating rate employed during soaking was 5-10° C./s. The soaked steel was cooled and subjected to roughening deformation by compression in the temperature range 1080-1100° C. applying deformation in the range 62-85%. The rough rolled steel was further cooled and subjected to hot rolling with finishing rolling temperature in the range 1000-1010° C. applying deformation 55-70%. The steel finished rolled steel was cooled using rate at least 5-7° C./s and coiled in temperature range 415-450° C. followed by air cooling to room temperature.

The steel given in example 3 was reheated in the temperature 1200-1215° C. The heating rate employed during soaking was 5-10° C./s. The soaked steel was cooled and subjected to rough deformation around 60-85% in the temperature range. The rough rolled steel was cooled and subjected to hot rolling deformation 50-65% using several passes and the steel was finish rolled in the temperature 1015-1030° C. The steel finished rolled steel was cooled using rate not less than 3-5° C./s and coiled in temperature range 415-450° C. followed by air cooling to room temperature.

The steel produced as per the current invention has excellent combination of tensile strength and ductility to make it useful for automotive structural application and several other areas where good combination of tensile strength and elongation properties is needed. Also, the presence of low silicon in the developed product allows the steel to be rolled in conventional hot strip mill. Further, low silicon in the steel reduces scale formation issues during hot rolling. The product developed with relatively low silicon is expected to improve coat ability and surface texture. Also, low carbon equivalent of the steel will allow easily weldable and presence of Aluminium in the developed product increases the castability.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Any discussion of documents, acts, materials, devices, articles and the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

While considerable emphasis has been placed herein on the particular features of this disclosure, it will be appreciated that various modifications can be made, and that many changes can be made in the preferred embodiments without departing from the principles of the invention. These and other modifications in the nature of the invention or the preferred embodiments will be apparent to those skilled in the art from the disclosure herein, whereby it is to be distinctly understood that the foregoing descriptive matter is to be interpreted merely as illustrative of the invention and not as a limitation. It is further understood that the scope of the present invention fully encompasses other embodiments that may become obvious to those skilled in the art and that the scope of the present invention is accordingly limited by nothing other than the appended claims.

We claim:

1. An ultra-high-strength hot-rolled steel strip or sheet with tensile strength of at least 1100 MPa and total elongation not less than 21%, comprising in weight percentage:

C: 0.12 to 0.24;
Mn: 0.8 to 2.1;
Si: 0.4 to 1.1;
Cr: 0.8 to 1.5;
Al—0.05 to 0.3;
Mo: 0.05 to 0.25;
Nb: 0.018 to 0.035;
Ti—0.01 to 0.1;
S—0.008 max;
P—0.025 max;
N—0.005 max; and the ultra high strength hot-rolled steel strip or sheet has a thickness of 10 mm or greater with a strain hardening exponent value in a range of 0.15 to 0.19 and has by volume 10-14% martensite, 85-80% bainite free of carbide and 5-6% austenite.

2. The ultra-high-strength hot-rolled steel strip or sheet as claimed in claim 1, wherein Mo, Si, Al, Ti, Cr varies in the range of 0.08 to 0.12, 0.4 to 0.8, 0.1 to 0.29, 0.02 to 0.04 and 0.85 to 1.1 respectively.

3. The ultra-high-strength hot-rolled steel strip or sheet as claimed in claim 1, wherein the steel has YS to TS greater than 0.6.

4. The ultra-high-strength hot-rolled steel strip or sheet as claimed in claim 1, wherein the steel possesses tensile strength in the range 1100 to 1150 MPa.

5. The ultra-high-strength hot-rolled steel strip or sheet as claimed in claim 1, wherein the steel possesses total elongation in the range of 20 to 23%.

6. The ultra-high-strength hot-rolled steel strip or sheet as claimed in claim 1, wherein the steel possesses minimum uniform elongation in the range of 10 to 12%.

7. The ultra-high-strength hot-rolled steel strip or sheet as claimed in claim 1, wherein the steel possesses tensile toughness in the range 19-23.5 GPa %.

8. The ultra-high-strength hot-rolled steel strip or sheet as claimed in claim 1, wherein bainite plate thickness is below 500 nm and martensitic grain size is less than 5-6 micron.

9. The ultra-high-strength hot-rolled steel strip or sheet as claim 1, made by a method comprising:

casting a steel with composition:

soaking the steel at a temperature in the range of 1200-1260° C.;

rough rolling the steel at a temperature in the range of 1080-1100° C.;

finishing rolling the steel at a temperature in the range of 1000-1030° C.;

cooling the finish rolled steel with a cooling rate of 3-7° C./s; and coiling the steel at a temperature in the range of 415-450° C.

10. The ultra-high-strength hot-rolled steel strip or sheet as claimed in claim 9, wherein soaking of the steel is done at heating rate 5-10° C. to at a heating rate of 5-10° C./s.

11. The ultra-high-strength hot-rolled steel strip or sheet as claimed in claim 9, wherein the steel is deformed 55-85% in rough rolling.

12. The ultra-high-strength hot-rolled steel strip or sheet as claimed in claim 9, wherein the steel is cooled after rough rolling.

13. The ultra-high-strength hot-rolled steel strip or sheet as claimed in claim 9, wherein the steel is deformed 50-70% in finish rolling.

14. The ultra-high-strength hot-rolled steel strip or sheet as claimed in claim 9, wherein the steel is air cooled to room temperature after finish rolling.

* * * * *